US007575451B1

(12) United States Patent
Jaramillo et al.

(10) Patent No.: US 7,575,451 B1
(45) Date of Patent: Aug. 18, 2009

(54) INTEGRATED GUIDING AND CAMMING SYSTEM FOR BOARD

(75) Inventors: Joel Jaramillo, Round Rock, TX (US); Vibora Sim, Pflugerville, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 12/246,199

(22) Filed: Oct. 6, 2008

(51) Int. Cl.
*H01R 13/62* (2006.01)

(52) U.S. Cl. ..... 439/157

(58) Field of Classification Search ..... 439/157
See application file for complete search history.

(56) References Cited

U.S. PATENT DOCUMENTS

| | | | | | |
|---|---|---|---|---|---|
| 3,193,342 | A * | 7/1965 | Sauter | 312/332.1 |
| 3,899,794 | A * | 8/1975 | Brown, Jr. | 360/133 |
| 4,421,372 | A * | 12/1983 | Golden | 439/296 |
| 4,776,811 | A | 10/1988 | Humphrey | 439/378 |
| 5,003,431 | A * | 3/1991 | Imsdahl | 361/798 |
| 5,506,758 | A * | 4/1996 | Cromwell | 361/798 |
| 6,056,567 | A * | 5/2000 | Schell | 439/160 |
| 6,059,600 | A | 5/2000 | Vanbesien | 439/378 |
| 6,373,713 | B1 * | 4/2002 | Jensen et al. | 361/759 |
| 6,762,934 | B2 * | 7/2004 | Kitchen et al. | 361/679.58 |
| 6,915,562 | B2 * | 7/2005 | Joist et al. | 29/758 |
| 6,916,190 | B2 * | 7/2005 | Joist | 439/160 |
| 7,264,490 | B1 * | 9/2007 | Reznikov | 439/152 |

OTHER PUBLICATIONS

Patent Application Under Client Reference No. DC-12729, "Multi-Stage Alignment Guidepin", Bailey et al., 19 pages.

* cited by examiner

*Primary Examiner*—Michael C Zarroli
*Assistant Examiner*—Vladimir Imas
(74) *Attorney, Agent, or Firm*—Baker Botts L.L.P.

(57) ABSTRACT

According to some embodiments, a method of connecting a first and second mateable connector to each other may comprise (a) grossly aligning a first connector piece (e.g., male or female) and a lever unit (or cam platform) fixed to a first information handling system component with a second connector piece (e.g., male or female) and a cam platform (or lever unit), respectively, fixed to a second information handling system component, (b) inserting at least a portion of a guide pin into a guide receptacle, (c) moving at least a portion of a camming end of a cam lever across a camming surface of a cam shaft, and (d) translating the lateral movement across the camming surface into vertical movement to press together the first and second connector pieces.

20 Claims, 10 Drawing Sheets

INTEGRATED GUIDING AND CAMMING SYSTEM FOR BOARD

TECHNICAL FIELD

The present disclosure relates in general to connectors for information handling system components, and more particularly to connectors that facilitate component insertion and extraction.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Information handling systems often utilize a number of modules (e.g., servers) mounted in racks. Proper insertion of these devices into their respective racks requires physical and electrical connections between the device and the system. However, an individual inserting the device may be required to apply force directly to the server, either through pushing or pulling, to connect male and female connectors. In addition, to insert or remove a device from a system, an individual may be required to apply force to the device in a direction non-parallel to the connector. Consequently, connector pins may be damaged (e.g., bent) by the application of such forces. In addition, damage to servers, racks and other components may result from the application of oblique forces during module insertion and/or removal.

SUMMARY

Accordingly, a need has arisen for improved connectors that allow modules to be connected with reduced risk of damage to connectors and/or other system components. The present disclosure relates to connectors that facilitate module insertion and extraction. In accordance with the teachings of the present disclosure, the disadvantages and problems associated with damaged connectors and other components associated with installation and removal of modular components have been substantially reduced or eliminated.

According to some embodiments, a system to facilitate connecting and disconnecting a first and second mateable connector may comprise (a) a cam platform lever and (b) a lever unit separable from the cam platform. A cam platform lever unit may comprise (i) a cam base, (ii) a cam arm extending vertically from the cam base and comprising a cam shaft and a pair of struts, each strut fixed to the cam shaft at one end and the cam base at the other end, and (iii) a guide pin extending vertically from the cam base and parallel to the cam arm in some embodiments. A lever unit separable from the cam platform may comprise, according to some embodiments, (i) a cam lever comprising a cam lever arm, a camming end comprising an install surface configured to contact at least a portion of the cam shaft, a remove surface configured to contact at least a portion of the cam shaft, and an axel operably linked to the cam lever arm and the camming end, and (ii) a lever platform comprising a lever base defining a guide receptacle configured to releasably receive the guide pin, a pedestal connected at one end to the lever base, a first and second plate, both connected to the end of the pedestal opposite from the lever base, each parallel to the other and parallel to the lengthwise axis of the pedestal, and each defining a cam ridding surface positioned to face the opposing cam riding surface, the cam riding surfaces rotatably engaged with the cam lever axel. In some embodiments, the cam lever arm is configured to ambulate the install surface of the camming end across the cam shaft to produce a force tending to press together the lever unit and the cam base when the cam lever arm is rotated in one direction and to ambulate the remove surface across the cam shaft to produce a force tending to press apart the lever unit and the cam base when the cam lever arm is rotated in the other direction.

A cam shaft may have a generally cylindrical shape with a cylinder axis perpendicular to the lengthwise axis of at least one of the struts, according to some embodiments. A guide pin may comprise, in some embodiments, a guide pin stem connected to the cam base and a guide pin cap connected to the guide pin stem at the end opposite from the cam base. According to some embodiments, an install surface may be configured to contact the side of the cam shaft proximal to the cam base. A remove surface may be configured to contact the side of the cam shaft distal to the cam base in some embodiments. A lever base may define, according to some embodiments, a horizontal plane and the plane of guide receptacle is parallel to the horizontal plane of the lever base.

According to some embodiments, an information handling system may comprise (a) a processor, (b) a memory communicatively coupled to the processor, (c) a local storage resource communicatively coupled to the processor, (d) a connector pair comprising a first connector piece and a second connector piece configured to communicatively couple and releasably engage each other, (e) a cam platform fixed to the first connector piece, and (f) a lever unit fixed that is to the second connector piece and separable from the cam platform. The cam platform may comprise (i) a cam base, (ii) a cam arm extending vertically from the cam base and comprising a cam shaft and a pair of struts, each strut fixed to the cam shaft (e.g., at opposite ends of the cam shaft) at one of their ends and the cam base at the other of their ends, (iii) a guide pin extending vertically from the cam base and parallel to the cam arm (e.g., from the same face of the base as the cam arm) in some embodiments. The lever unit may comprise, according to some embodiments, (i) a cam lever comprising a cam lever arm, a camming end comprising an install surface configured to contact at least a portion of the cam shaft, a remove surface configured to contact at least a portion of the cam shaft, and an axel operably linked to the arm and the camming end, and (ii) a lever platform comprising a lever base defining a guide receptacle configured to releasably receive the guide pin, a pedestal connected at one end to the lever base, a first and second plate, both connected to the end of the pedestal opposite from the lever base, each parallel to the other and parallel to the lengthwise axis of the pedestal, and each defining a cam ridding surface positioned to face the opposing cam riding surface, the cam riding surfaces rotatably engaged with the cam lever axel. In some embodiments, the camming end may be configured with an upper jaw and a lower jaw, the upper jaw comprising the remover surface and the lower jaw comprising the install surface. The cam lever arm is configured to ambulate the install surface of the camming end across the cam shaft to produce a force tending to press the cam base and the first connector piece together with the lever unit and the second connector piece when the cam lever arm is rotated in one direction and/or to ambulate the remove surface across the cam shaft to produce a force tending to press the cam base and the first connector piece apart from the lever unit and the second connector piece when the cam lever arm is rotated in the other direction, according to some embodiments.

The first connector piece may comprise, in some embodiments, an array of connector pins and the second connector piece may comprise a corresponding array of holes configured to receive the connector pins. According to some embodiments, the second connector piece may comprise an array of connector pins and the first connector piece may comprise a corresponding array of holes configured to receive the connector pins. The cam platform may be fixed (e.g., attached, adhered, soldered, welded, bonded) directly or indirectly to a first (or second) connector piece in some embodiments. For example, the cam platform may be indirectly fixed to the first connector through a main board or a card (e.g., where both the cam platform and the first connector piece are fixed to the card or board). The lever unit may be fixed (e.g., attached, adhered, soldered, welded, bonded), according to some embodiments, directly or indirectly to a first (or second) connector piece. For example, the lever unit may be indirectly fixed to the first connector through a main board or a card (e.g., where both the lever unit and the first connector piece are fixed to the card or board). In some embodiments, an information handling system may comprise a second cam platform fixed to the first connector piece, a second lever unit that is fixed to the second connector piece and separable from the cam platform. The second cam lever arm may be configured to ambulate the second install surface of the second camming end across the second cam shaft to produce a force tending to press the second cam base and the first connector piece together with the second lever unit and the second connector piece when the second cam lever arm is rotated in one direction and to ambulate the second remove surface across the second cam shaft to produce a force tending to press the second cam base and the first connector piece apart from the second lever unit and the second connector piece when the second cam lever arm is rotated in the other direction, according to some embodiments.

An information handling system may be configured, in some embodiments, with the cam platform adjacent to one end of the first connector piece and the second cam platform is adjacent to an opposite end of the first connector piece. Similarly, the lever unit may be adjacent to one end of the second connector piece and the second lever unit may be adjacent to an opposite end of the second connector piece, in some embodiments.

According to some embodiments, a method of connecting a first and second mateable connector to each other may comprise (a) grossly aligning a first connector piece (e.g., male or female) and a lever unit (or cam platform) fixed to a first information handling system component with a second connector piece (e.g., male or female) and a cam platform (or lever unit), respectively, fixed to a second information handling system component, (b) inserting at least a portion of a guide pin into a guide receptacle, (c) moving at least a portion of a camming end of a cam lever across a camming surface of a cam shaft, and (d) translating the lateral movement across the camming surface into vertical movement to press together the first and second connector pieces. A cam platform may comprise (i) a cam base, (ii) a cam arm extending vertically from the cam base and comprising a cam shaft and a pair of struts, each strut fixed to the cam shaft at one end and the cam base at the other end, (iii) a guide pin extending vertically from the cam base and parallel to the cam arm, in some embodiments. A lever unit may comprise, according to some embodiments, (i) a cam lever comprising a cam lever arm, a camming end comprising an install surface configured to contact at least a portion of the cam shaft, a remove surface configured to contact at least a portion of the cam shaft, and an axel operably linked to the arm and the camming end, and (ii) a lever platform comprising a lever base defining a guide receptacle configured to releasably receive the guide pin, a pedestal connected at one end to the lever base, a first and second plate, both connected to the end of the pedestal opposite from the lever base, each parallel to the other and parallel to the lengthwise axis of the pedestal, and each defining a cam ridding surface positioned to face the opposing cam riding surface, the cam riding surfaces rotatably engaged with the cam lever axel. In some embodiments, the cam lever arm may be configured to ambulate the install surface of the camming end across the cam shaft to produce a force tending to press the cam base and the first connector piece together with the lever unit and the second connector piece when the cam lever arm is rotated in one direction. A method may further comprise aligning a second lever unit fixed to the first information handling system component with a second cam platform fixed to the second information handling system component, according to some embodiments. The first and second cam platforms may be positioned, in some embodiments, on opposite ends of the first connector piece. According to some embodiments, the first and second lever units may be positioned on opposite ends of the first connector piece. The first information handling system component may comprise a main board (e.g., motherboard, a planar board) and the second information handling system component may comprise a card (e.g., a riser card).

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1A:
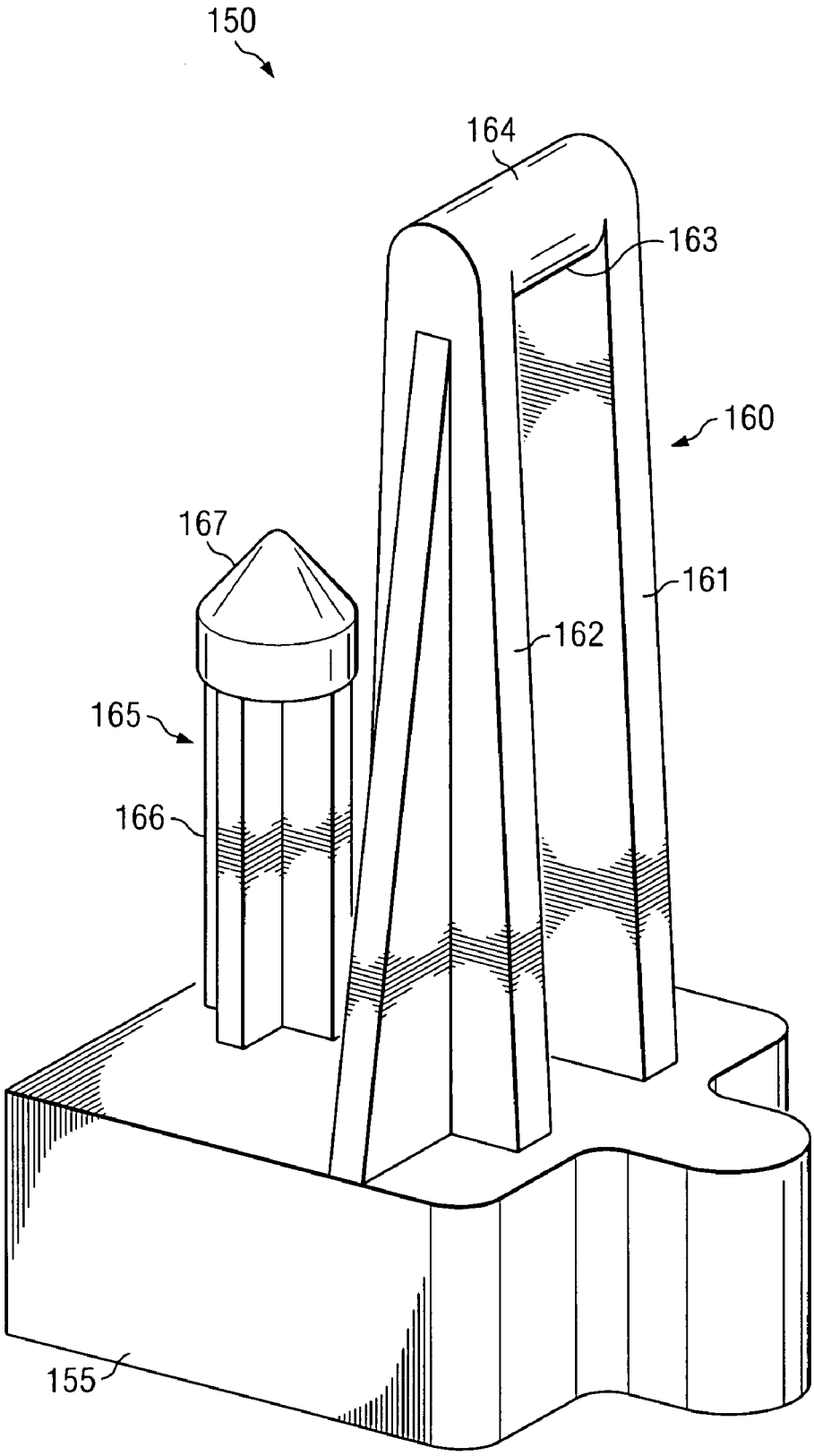
FIG. 1A is an isometric view of an example embodiment of a cam lever, in accordance with the present disclosure.

Preferred embodiments and their advantages are best understood by reference to FIGS. 1-4, wherein like numbers are used to indicate like and corresponding parts.

For the purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system may be a personal computer, a PDA, a consumer electronic device, a network storage device, or any other suitable device and may vary in size, shape, performance, functionality, and price. The information handling system may include memory, one or more processing resources such as a central processing unit (CPU) or hardware or software control logic. Additional components or the information handling system may include one or more storage devices, one or more communications ports for communicating with external devices as well as various input and output (I/O) devices, such as a keyboard, a mouse, and a video display. The information handling system may also include one or more buses operable to transmit communication between the various hardware components.

For the purposes of this disclosure, computer-readable media may include any instrumentality or aggregation of instrumentalities that may retain data and/or instructions for a period of time. Computer-readable media may include, without limitation, storage media such as a direct access storage device (e.g., a hard disk drive or floppy disk), a sequential access storage device (e.g., a tape disk drive), compact disk, CD-ROM, DVD, random access memory (RAM), read-only memory (ROM), electrically erasable programmable read-only memory (EEPROM), and/or flash memory; as well as communications media such wires, optical fibers, microwaves, radio waves, and other electromagnetic and/or optical carriers; and/or any combination of the foregoing.

An information handling system may include or may be coupled via a network to one or more arrays of storage resources. The array of storage resources may include a plurality of storage resources, and may be operable to perform one or more input and/or output storage operations, and/or may be structured to provide redundancy. In operation, one or more storage resources disposed in an array of storage resources may appear to an operating system as a single logical storage unit or "logical unit."

In certain embodiments, an array of storage resources may be implemented as a Redundant Array of Independent Disks (also referred to as a Redundant Array of Inexpensive Disks or a RAID). RAID implementations may employ a number of techniques to provide for redundancy, including striping, mirroring, and/or parity checking. As known in the art, RAIDs may be implemented according to numerous RAID standards, including without limitation, RAID 0, RAID 1, RAID 0+1, RAID 3, RAID 4, RAID 5, RAID 6, RAID 01, RAID 03, RAID 10, RAID 30, RAID 50, RAID 51, RAID 53, RAID 60, RAID 100, etc.

FIGS. 1A-1E illustrate an example cam unit and components thereof. Each component of a cam unit independently (e.g., up to an entire unit) may comprise one or more materials selected from thermoplastics, epoxy resins, polyacrylics, polycarbonates, polyethylene, polyolefins, polypropylene, polystyrene, polyurethanes, polyvinyl chloride, vinyl plastics, and combinations thereof. It may be desirable and/or necessary to use one or more other materials (e.g., other rigid materials) in some embodiments.

FIG. 1A illustrates an example cam platform configured to facilitate connection of information handling system components. As depicted in FIG. 1A, cam platform 150 may comprise base 155, cam arm 160, and guide pin 165.

Base 155 may be contiguous with and/or fixed to cam arm 160 and/or guide pin 165. Base 155 may provide an anchor for cam platform 150. For example, cam platform 150 may be fixed to a first component (e.g., a riser board, a video card, a hard drive, a planar board, and/or a mainboard) to be connected to a second component (e.g., a riser board, a video card, a hard drive, a planar board, and/or a mainboard).

As depicted, cam arm 160 may comprise struts 161 and 162, cam shaft 163, and camming surface 164. Struts 161 and 162 may support and/or transmit forces applied to cam shaft 163 (e.g., at camming surface 164) to base 155 and/or through base 155 to an attached component, if any. Struts 161 and 162 may be relatively wide near base 155 and taper towards cam shaft 163. Struts 161 and 162 may also comprise one or more buttresses configured, for example, to resist forces oblique to the lengthwise axis of cam arm 160.

Cam shaft 163 may be fixed to one or more struts (e.g., struts 161 and 162) and/or may have a generally cylindrical shape. Cam shaft 163 may be positioned with its symmetry axis perpendicular to the lengthwise axis of struts 161 and 162 and/or parallel to the plane of base 155.

Camming surface 163 may extend across at least a portion of the circumferential area of cam shaft 163.

As depicted, guide pin 165 may comprise guide pin stem 166 and guide pin cap 167. Guide pin stem 166 may connect guide pin cap 167 to base 155. Guide pin cap may be configured to include a pre-alignment portion (e.g., a tapering cone shape located at the end of the guide pin) and an alignment portion connected to the pre-alignment portion (e.g., cylindrical having a constant diameter) and/or stem 167. Guide pin stem 167 may be cylindrical (e.g., with a constant diameter). The diameter of guide pin cap (e.g., along the alignment portion) may be greater than the diameter of guide pin stem 167.

Figure 1B:
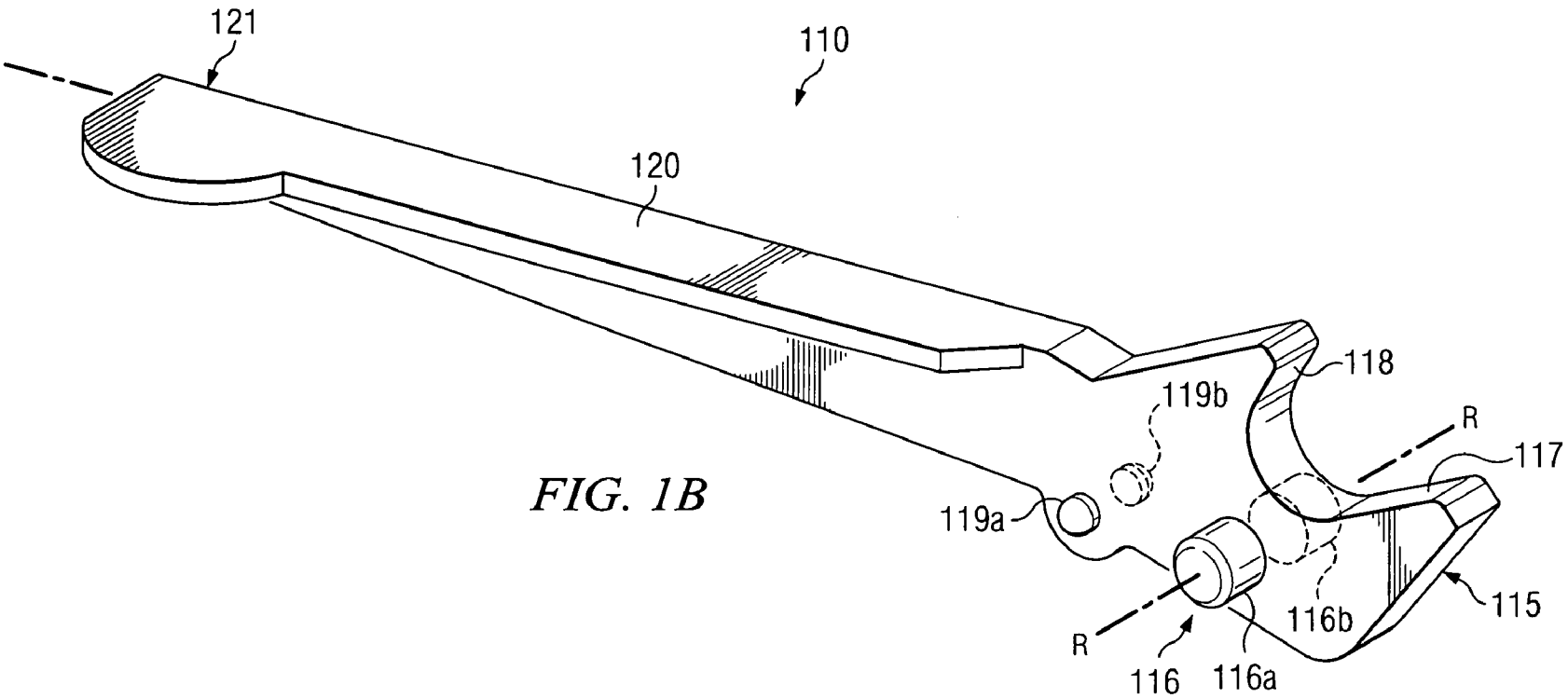
FIG. 1B is an isometric view of an example embodiment of a lever platform, in accordance with the present disclosure.

FIG. 1B illustrates an example cam lever configured to facilitate connection of information handling system components. As depicted in FIG. 1B, cam lever 110 may comprise camming end 115, arm 120, and handle 121. Cam lever 110 may be configured to comprise lengthwise axis L-L and rotational axis R-R perpendicular to axis L-L.

Camming end 115 may comprise axel 116, install surface 117 and remove surface 118, and projections 119. Camming end 115 may be fixed to and ambulated by arm 120.

Axel 116 may comprise a pair of lateral projections 116*a* and 116*b*, each extending outwardly from opposite sides of camming end 115 along rotational axis R-R. Lateral projections 116*a* and 116*b* may rotatably engage cam riding surfaces 141 and 146, respectively.

Install surface 117 may be configured to contact camming surface 164 (e.g., a portion of camming surface 164 proximal to base 155). Install surface 117 may be contoured to contact camming surface 164 with increasing force as camming end is rotated about axis R-R by arm 120. Remove surface 118 may be configured to contact camming surface 164 (e.g., a portion of camming surface 164 distal to base 155). Remove surface 118 may be contoured to contact camming surface 164 with increasing force as camming end is rotated about axis R-R by arm 120. Install surface 117 and remove surface 118 may be configured such that only one of install surface 117 and remove surface 118 contacts camming surface 164 at a time.

Projections 119*a* and 119*b* may extend laterally from opposite sides of camming end 115 and may be configured to engage detents 142, 143, 147, and 148. More specifically, projections 119*a* and 119*b* may respectively engage detents 142 and 147 when cam lever 110 (e.g., camming end 115) is in a closed position. Projections 119*a* and 119*b* may respectively engage detents 143 and 148 when cam lever 110 (e.g., camming end 115) is in an open position.

Figure 1C:
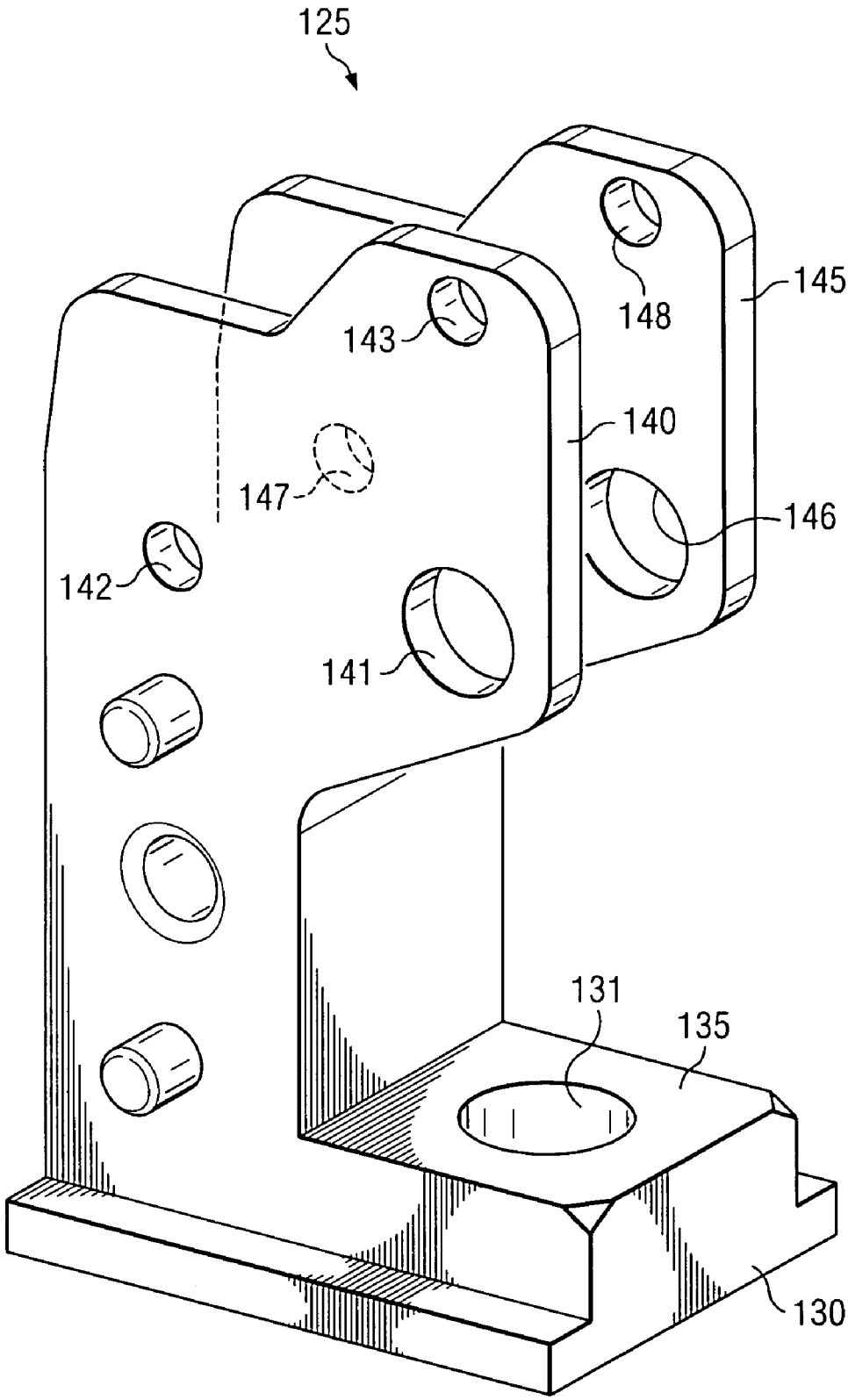
FIG. 1C is an isometric view of an example embodiment of a cam lever unit comprising a cam lever and a lever platform, in accordance with the present disclosure.

FIG. 1C illustrates an example lever platform configured to facilitate connection of information handling system components. As depicted in FIG. 1C, lever platform 25 may comprise base 130, guide receptacle 131, pedestal 135, side plate 140, cam riding surface 141, closed detent 142, open detent 143, side plate 145, cam riding surface 146, closed detent 147, and open detent 148.

Base 130 may be contiguous with and/or fixed to pedestal 135. Base 130 may provide an anchor for pedestal 135. For example, base 135 may be fixed to a first component (e.g., a riser board, a video card, a hard drive, a planar board, and/or a mainboard) to be connected to a second component (e.g., a riser board, a video card, a hard drive, a planar board, and/or a mainboard). Base 130 may define a generally cylindrical aperture, guide receptacle 131, configured to receive guide pin 165.

Pedestal 135 may support and/or transmit forces applied to cam riding surface 141 to base 130 and/or through base 130 to an attached component, if any. Pedestal 135 may have an upper and lower end, fixed at the lower end to base 130 and upper end to side plates 140 and 145. A lengthwise axis of pedestal 135 may be parallel to the cylinder axis of guide receptacle 131.

Side plate 140 may be generally flat and comprise cam riding surface 141, closed detent 142, and open detent 143. Side plate 145 may be generally flat and comprise cam riding surface 146, closed detent 147, and open detent 148. A lengthwise axis of pedestal 135 may be parallel to planes defined by side plate 140 and/or side plate 145. Planes defined by plates 140 and 145 may be parallel to each other.

Cam riding surfaces 141 and 146 may be positioned opposite of each other and may rotatably engage axel projections 116*a* and 116*b*, respectively. Cam riding surfaces 141 and 146 may be positioned in generally cylindrical apertures (as shown) and/or detents (not expressly shown) in side walls 140 and 146 respectively.

Closed detents 142 and 147 may be positioned opposite of each other and may releasably engage projections 119*a* and 119*b*, respectively. Open detents 143 and 147 may be positioned opposite of each other and may releasably engage projections 119*a* and 119*b*, respectively.

Figure 1D:
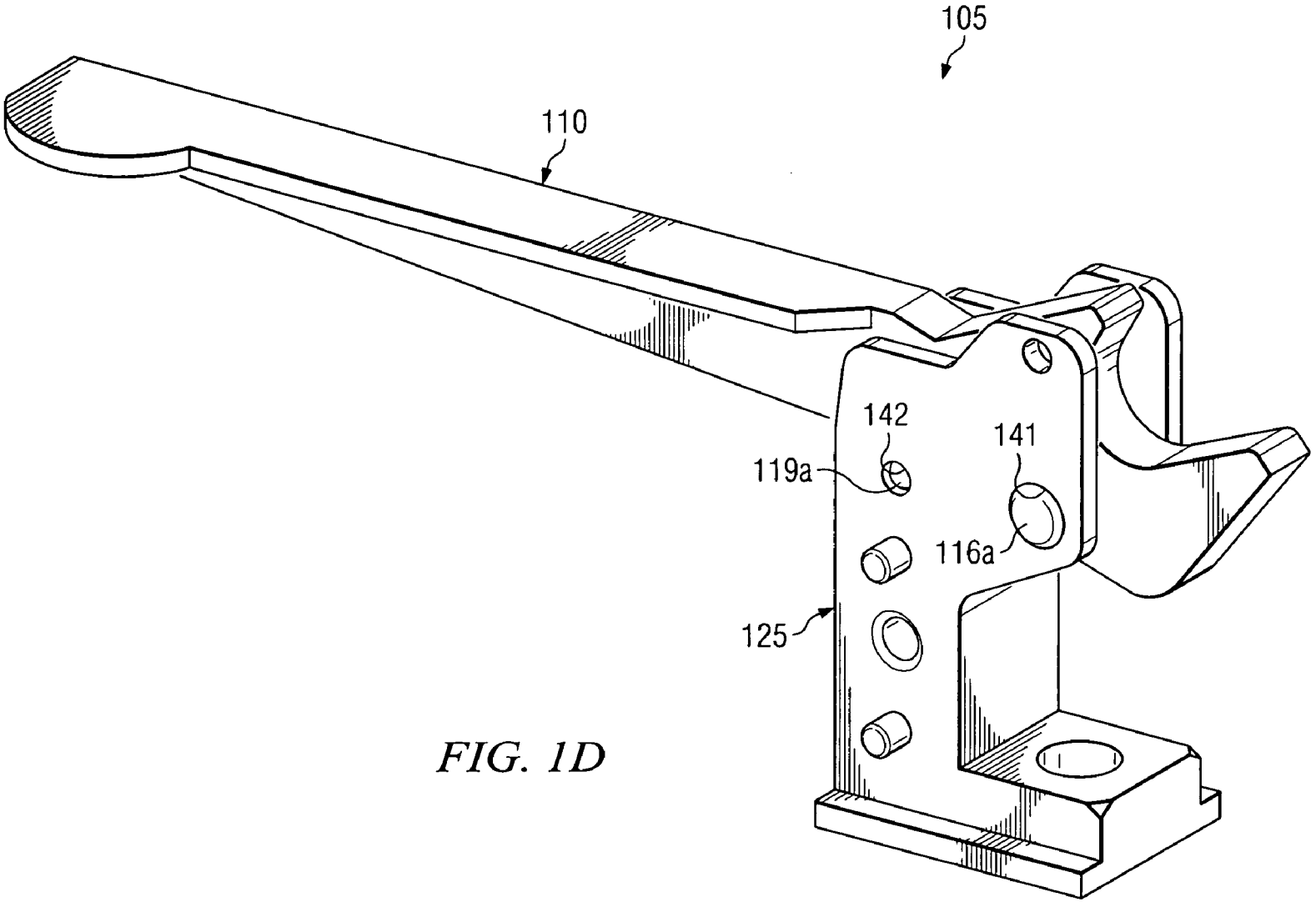
FIG. 1D is an isometric view of an example embodiment of a cam platform, in accordance with the present disclosure.

FIG. 1D illustrates an example lever unit configured to facilitate connection of information handling system components. As depicted in FIG. 1D, lever unit 105 may comprise cam lever 110 and lever platform 125. Axel projection 116*a* is shown rotatably engaged with cam riding surface 141 and projection 119*a* is releasably engaged with closed detent 142.

Figure 1E:
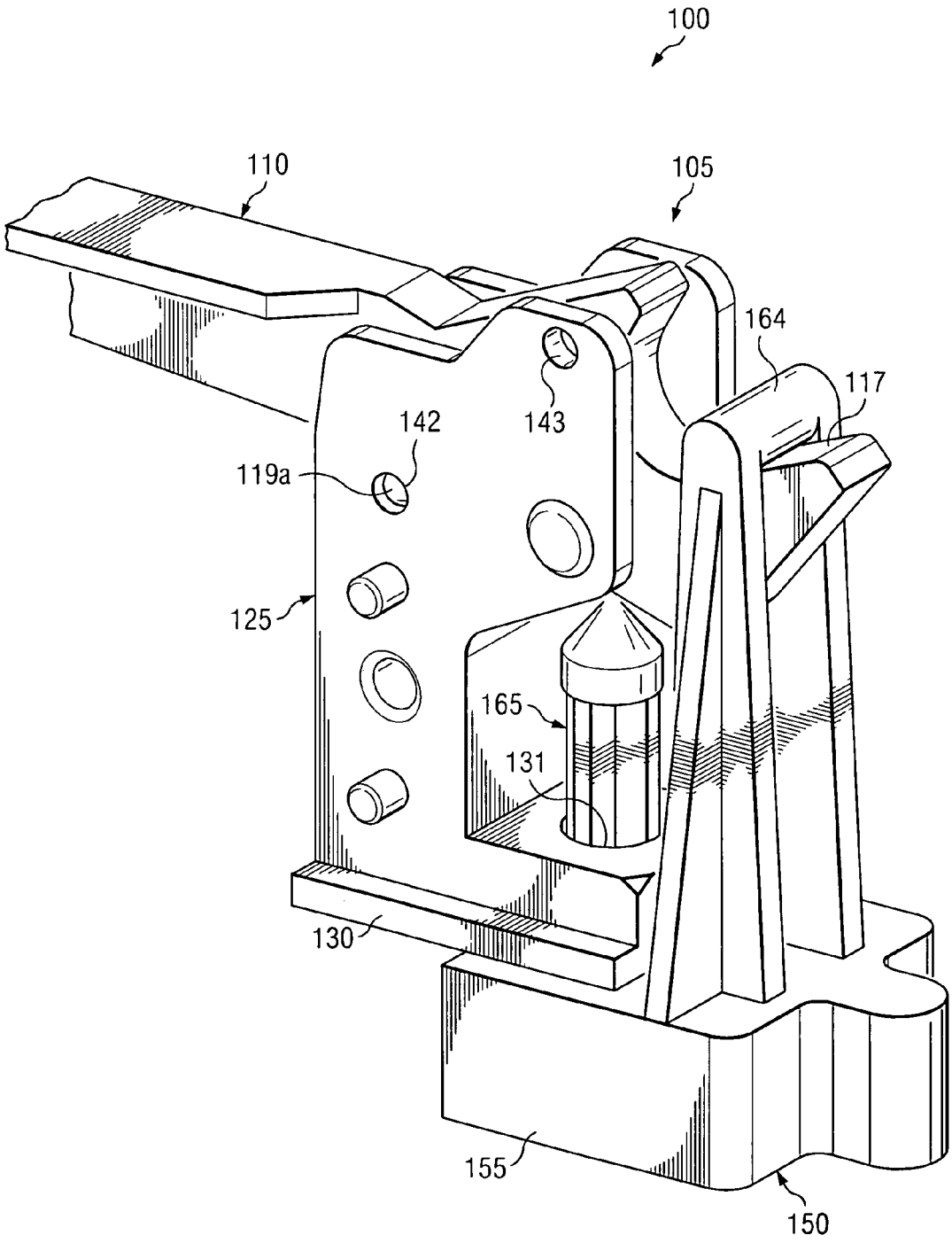
FIG. 1E is an isometric view of an example embodiment of a cam unit comprising a lever unit and a cam platform, in accordance with the present disclosure.

FIG. 1E illustrates an example cam unit configured to facilitate connection of information handling system components. As depicted in FIG. 1E, cam unit 100 is in a closed position and may comprise cam lever unit 105 and cam platform 150. Install surface 116 is shown contacting cam surface 164 on the side proximal to base 155. In addition, guide pin 165 is shown fully engaged with guide receptacle 131 and the underside of base 130 is adjacent to (e.g., contacts) the upper side of base 155. Projection 119*a* is releasably engaged with closed detent 142.

Figure 2A:
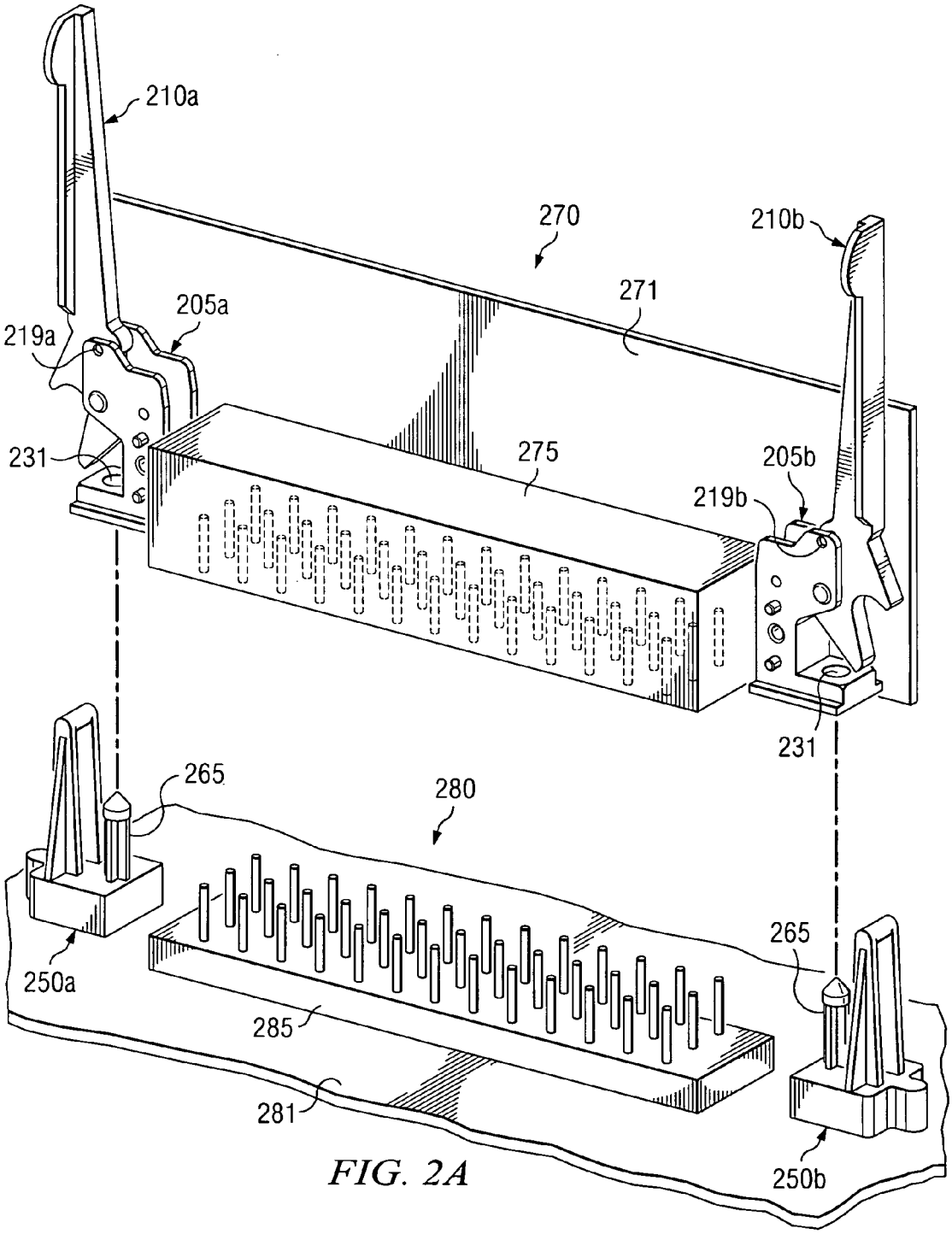
FIG. 2A is an isometric view of an example embodiment of a module comprising a lever unit and a female connector approaching a board comprising a cam platform and a male connector, in accordance with the present disclosure.

FIG. 2A illustrates an example information handling system card prepared to engage an example information handling system board. As depicted in FIG. 2A, information handling system card 270 may comprise lever units 205*a* and 205*b*, support 271, and female connector 275. As depicted in FIG. 2, information handling system board 280 may comprise cam platforms 250*a* and 250*b*, support 281, and male connector 285.

Lever units 205*a* and 205*b* may be fixed to opposing ends of a common side of support 271. Female connector 275 may be fixed to the same side and positioned between lever units 205*a* and 205*b*. Cam platforms 250*a* and 250*b* may be fixed to opposing ends of a common side of support 281. Male connector 285 may be fixed to the same side and positioned between cam platforms 250*a* and 250*b*. Lever unit 205*a* and cam platform 250*a* may be positioned on support 271 and support 281 respectively so as to align (e.g., operably align) with each other, for example, when female connector 275 and male connector 285 align.

Connectors 275 and 285, according to some embodiments, may comprise a connector selected from peripheral component interconnect (PCI), accelerated graphics port (AGP), small computer system interface (SCSI), and combinations thereof. In some embodiments, connectors may comprise a plurality of pins (e.g., an array of pins) and/or a plurality of holes (e.g., an array of holes) configured to receive a corresponding plurality pins.

In operation, cam levers 210*a* and 210*b* may be in an open position (e.g., with projections 219*a* and 219*b* engaged with open detents 243 and 248 respectively) and/or placed in an open position prior to connecting information handling system components. In addition, guide pins 265 may be approximately aligned with their respective guide receptacles 231.

Figure 2B:
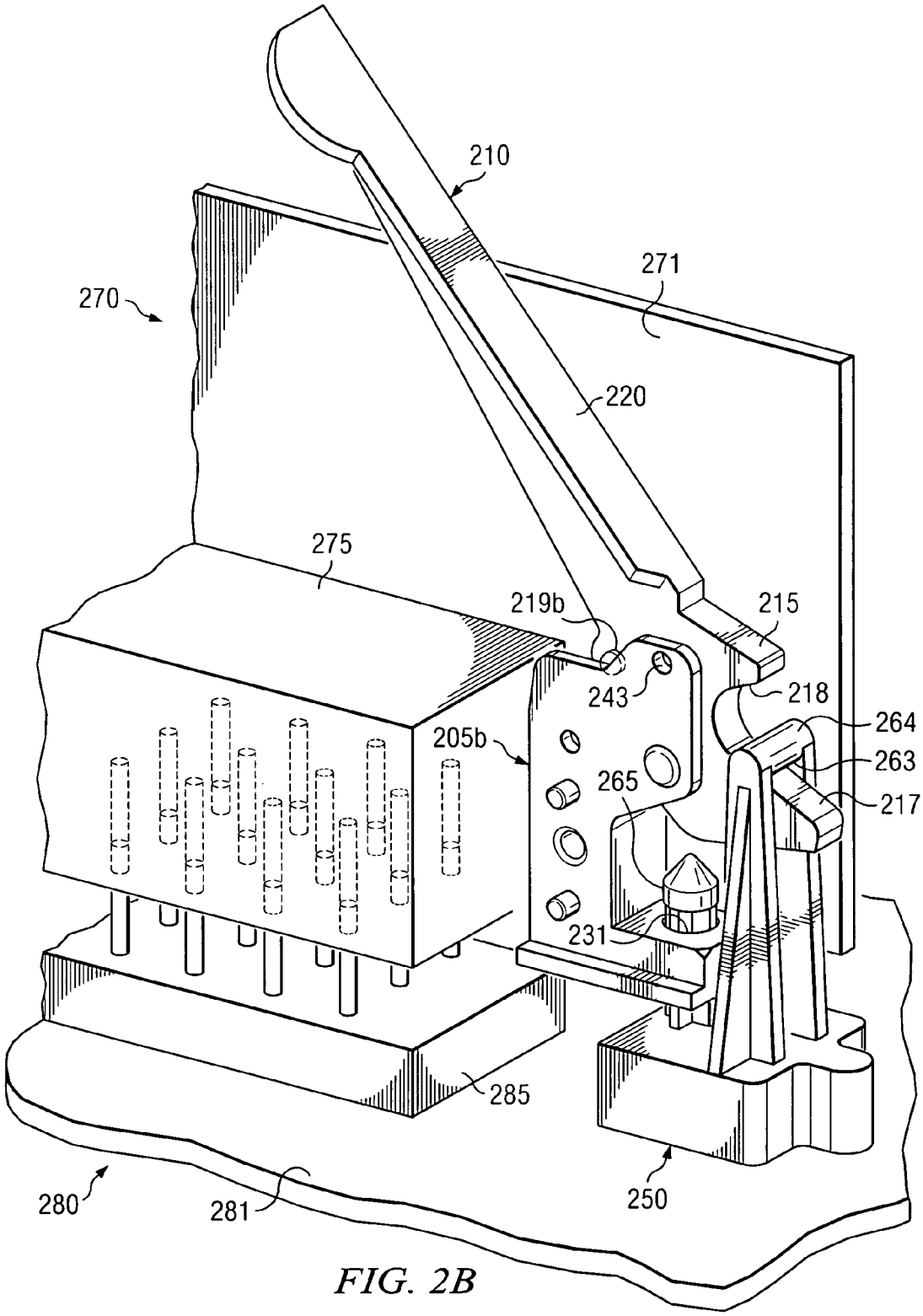
FIG. 2B is an isometric view of an example embodiment of a module comprising a lever unit and a female connector partially engaged with a board comprising a cam platform and a male connector, in accordance with the present disclosure.
Figure 2C:
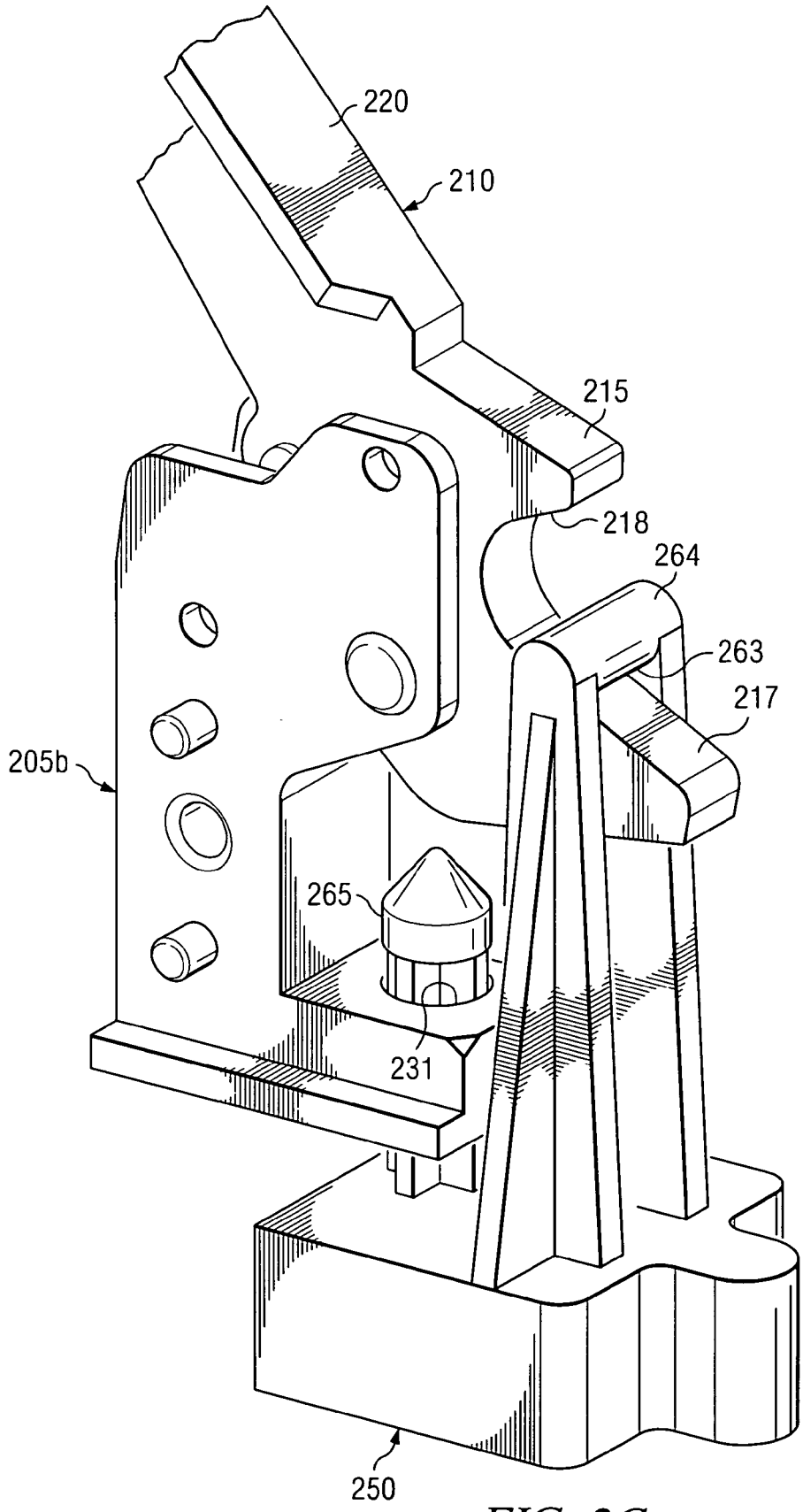
FIG. 2C is an exploded view of a cam unit shown in FIG. 2B.
Figure 2D:
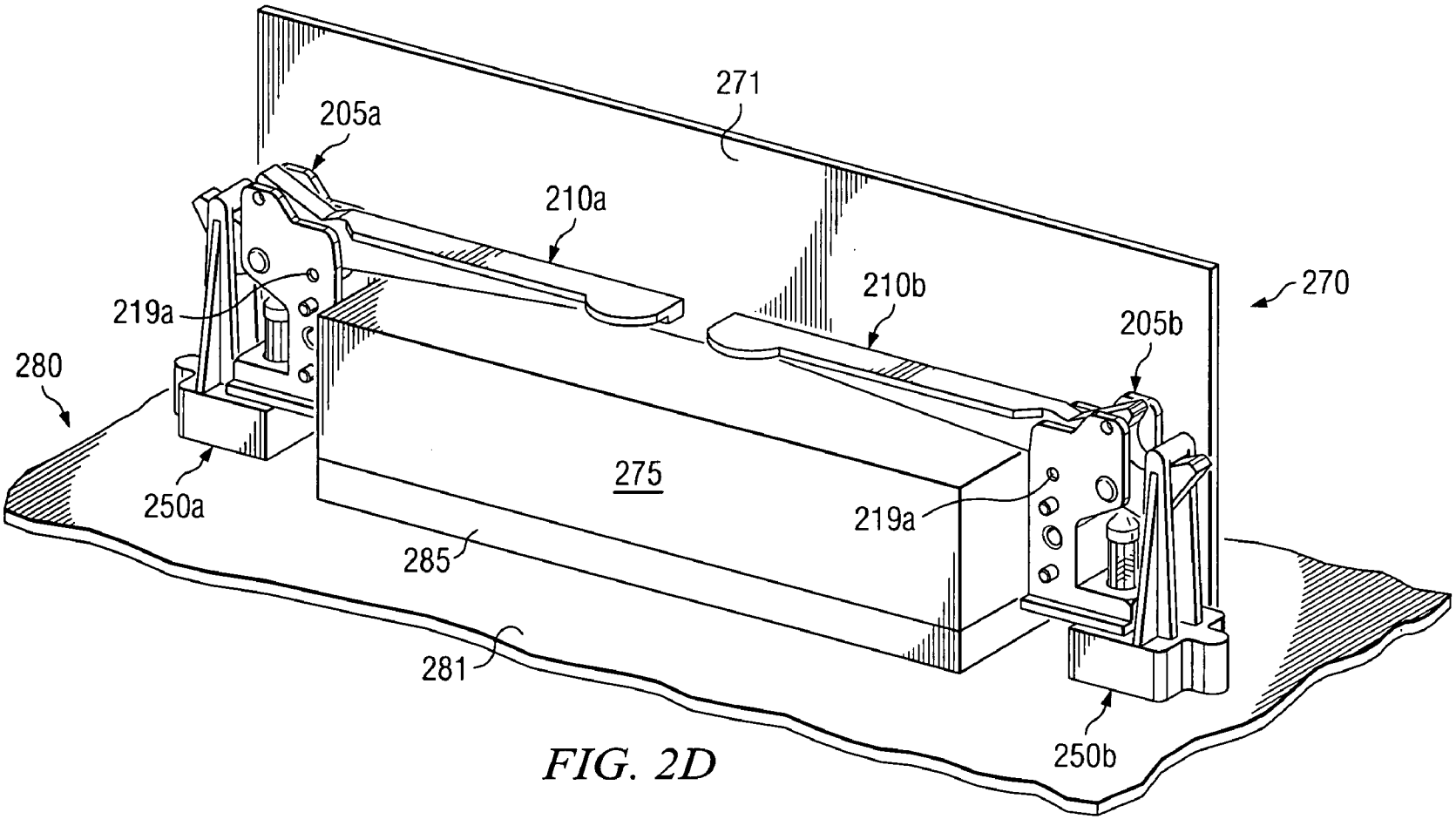
FIG. 2D is an isometric view of an example embodiment of a module comprising a lever unit and a female connector engaged with a board comprising a cam platform and a male connector, in accordance with the present disclosure.

FIGS. 2B and 2C illustrate the example information handling system card 270 and example information handling system board 280 shown in FIG. 2A. As depicted in FIG. 2B, information handling system card 270 is partially engaged with information handling system board 280. For example, guide pins 265 are partially inserted into respective guide receptacles 231, thereby bringing connectors 275 and 285 into alignment. In addition, arms 220 of each cam lever 210 are partially rotated toward a closed position ambulating their respective camming ends 215 into a position of partially engaging cam shafts 263. Specifically, rotating arms 220 back toward an open position will cause remove surfaces 218 to contact their respective camming surfaces 264 (e.g., distal to base 155). Continued application of force to open arms 220 is translated by camming ends 215 to movement tending to separate connectors 275 and 285 (FIG. 2A). On the other hand, rotating arms 220 toward a closed position will cause install surfaces 217 to contact their respective camming surfaces 264 (e.g., proximal to base 155). Continued application of force to close arms 220 is translated by camming ends 215 to movement tending to press together connectors 275 and 285 and complete their engagement (FIG. 2D). FIG. 2C illustrates an exploded view of lever unit 205*b* and cam platform 250*b* shown in FIG. 2B.

FIG. 2D illustrates the example information handling system card 270 and example information handling system board 280 shown in FIGS. 2A and 2B. As depicted in FIG. 2C, information handling system card 270 is completely engaged with information handling system board 280 (e.g., female connector 275 is fully engaged with male connector 285 and/or projections 119*a* and 119*b* are engaged with closed detents 142 and 147 respectively). Metrics for full engagement of connectors 275 and 285 may be electrical and/or optical connection of a desirable number of pins between connectors 275 and 285. In some embodiments, it may be desirable and/or required include a plurality of connectors (e.g., male and/or female) on card 270 and a plurality (e.g., a corresponding plurality of connectors (e.g., male and/or female) on board 280.

While the ratio of cam units to connector pairs (one male and one female) may be 1 unit to 1 pair (1:1), it may be desirable to use two or more cam units per connector pair.

Figure 3:
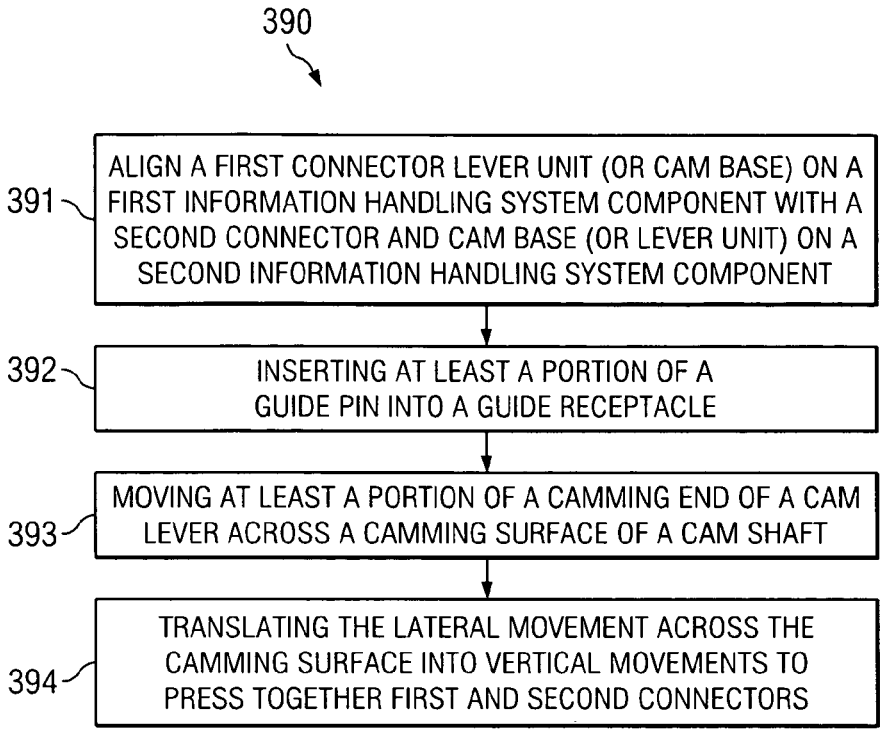
FIG. 3 is a flowchart illustrating an example embodiment of a method of engaging information handling system connectors using a cam unit, in accordance with the present disclosure.

FIG. 3 illustrates a flow chart of an example method 390 for engaging connectors, in accordance with the present disclosure. In one embodiment, method 390 comprises aligning 391 a first connector and lever unit (or cam platform) on a first information handling system component with a second connector and cam platform (or lever unit) on a second information handling system component, inserting 392 at least a portion of a guide pin into a guide receptacle, moving 393 at least a portion of a camming end of a cam lever across a camming surface of a cam shaft, and translating 394 the lateral movement across the camming surface into vertical movement to press together first and second connectors.

According to one embodiment, method 390 begins at step 391. As noted above, teachings of the present disclosure may be implemented in a variety of configurations of system 100. As such, the preferred initialization point for method 390 and the order of the steps 391-394 comprising method 390 may depend on the implementation chosen.

At step 391, a first connector on a first information handling system component is generally aligned with a second connector on a second information handling system component. A first connector may be a male connector or a female connector in some embodiments. A second connector may be a male connector or a female connector with the proviso that the second connector is compatible with the first connector. Step 391 may include aligning 391 a first connector (e.g., female connector 85) and cam platform 50 on board 80 with a corresponding second connector (e.g., male connector 75) and lever unit 5 on card 70.

At step 392, at least a portion of guide pin 65 (e.g., guide pin cap 67) is inserted into guide receptacle 31 to substantially align lever unit 5 and cam platform 50, which aligns connectors 75 and 85. Step 392 may comprise inserting 392 at least a portion of a first guide pin 65 into a first guide receptacle 31 and a second guide pin 65 into a second guide receptacle. Inserting guide pin 65 into guide receptacle 31 may tend to bring at least a portion of camming end 15 into contact with at least a portion of camming surface 64. Additional camming units may be used as desired or required.

At step 393, moving at least a portion of a camming end across a camming surface may include rotating arm 20 about axel 16 to ambulate camming end 15 and move install surface 17 (e.g., generally laterally) across camming surface 64. In some embodiment, lever units may be paired such that first camming end 15 is ambulated to move first install surface 17 across first camming surface 64 by clockwise rotation of first arm 20 and second camming end 15 is ambulated to move second install surface 17 across second camming surface 64 by counter-clockwise rotation of second arm 20.

At step 394, lateral movement of camming end 15 across install surface 17 is translated into vertical movement to press together first and second connectors. For example, the shapes (contours) of install surface 17 and/or camming surface 64 (e.g., a portion proximal to base 55) may be configured to translate this lateral movement into vertical movement tending to press together lever unit 5 and cam platform 50 and, consequently, items attached to lever unit 5 (e.g., female connector 85) and cam platform 50 (e.g., male connector 75).

Figure 4:
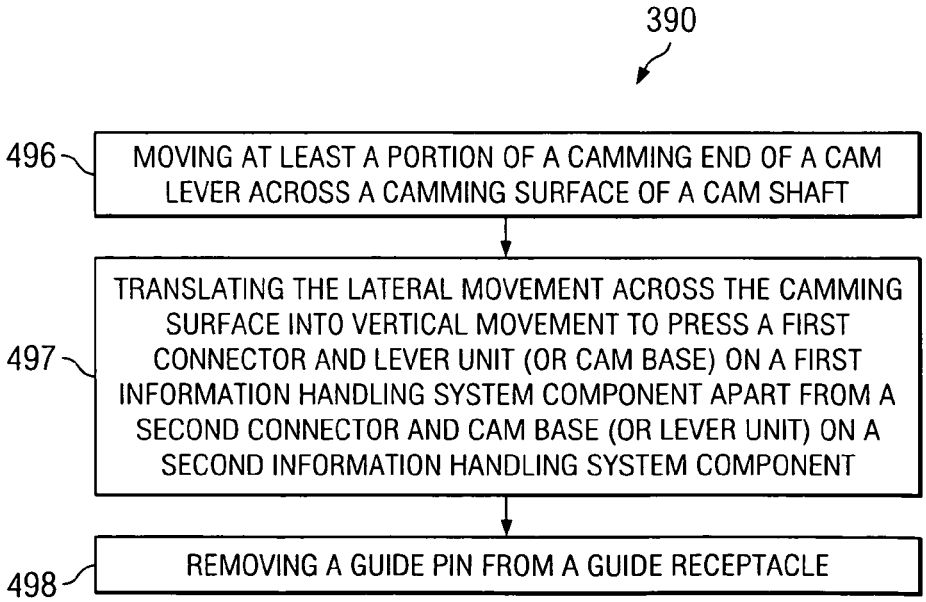
FIG. 4 is a flowchart illustrating an example embodiment of a method of disengaging information handling system connectors using a cam unit, in accordance with the present disclosure.

FIG. 4 illustrates a flow chart of an example method 495 for disengaging connectors, in accordance with the present disclosure. In one embodiment, method 495 comprises moving 496 at least a portion of a camming end of a cam lever across a camming surface of a cam shaft, translating 497 the lateral movement across the camming surface into vertical movement to press a first connector and lever unit (or cam platform) on a first information handling system component apart from a second connector and cam platform (or lever unit) on a second information handling system component, and removing 498 a guide pin from a guide receptacle.

According to one embodiment, method 495 begins at step 496. As noted above, teachings of the present disclosure may be implemented in a variety of configurations of system 100. As such, the preferred initialization point for method 495 and the order of the steps 496-498 comprising method 495 may depend on the implementation chosen.

At step 496, moving at least a portion of a camming end across a camming surface may include rotating arm 20 about axel 16 to ambulate camming end 15 and move remove surface 18 (e.g., generally laterally) across camming surface 64 (e.g., distal to base 55). In some embodiment, lever units may be paired such that first camming end 15 is ambulated to move first remove surface 18 across first camming surface 64 by clockwise rotation of first arm 20 and second camming end 15 is ambulated to move second remove surface 18 across second camming surface 64 by counter-clockwise rotation of second arm 20.

At step 497, lateral movement of camming end 15 across remove surface 18 is translated into vertical movement to press apart first and second connectors. For example, the shapes (contours) of remove surface 18 and/or camming surface 64 (e.g., a portion distal to base 55) may be configured to translate this lateral movement into vertical movement tending to press apart lever unit 5 and cam platform 50 and, consequently, items attached to lever unit 5 (e.g., female connector 85) and cam platform 50 (e.g., male connector 75).

At step 498, removing a guide pin from a guide receptacle may include backing guide pin 65 out (e.g., entirely out) of guide receptacle 31. This may be desired and/or required to free first and second information handling system components from each other.

Methods 390 and/or 495 may be implemented using system 0 (e.g., lever unit 5 and/or cam platform 50) or any other system operable to implement method 200. In certain embodiments, methods 390 and/or 495 may be implemented partially or fully in software embodied in computer-readable media.

Although the present disclosure has been described in detail, it should be understood that various changes, substitutions, and alterations can be made hereto without departing from the spirit and the scope of the disclosure as defined by the appended claims.

What is claimed is:

1. A system to facilitate connecting and disconnecting a first and second mateable connector, the system comprising:

(a) a cam platform lever unit comprising (i) a cam base, (ii) a cam arm extending vertically from the cam base and comprising a cam shaft and a pair of struts, each strut fixed to the cam shaft at one end and the cam base at the other end, (iii) a guide pin extending vertically from the cam base and parallel to the cam arm; and (b) a lever unit separable from the cam platform comprising (i) a cam lever comprising a cam lever arm, a camming end comprising an install surface configured to contact at least a portion of the cam shaft, a remove surface configured to contact at least a portion of the cam shaft, and an axel operably linked to the cam lever arm and the camming end, and (ii) a lever platform comprising a lever base defining a guide receptacle configured to releasably receive the guide pin, a pedestal connected at one end to the lever base, a first and second plate, both connected to the end of the pedestal opposite from the lever base, each parallel to the other and parallel to the lengthwise axis of the pedestal, and each defining a cam ridding surface positioned to face the opposing cam riding surface, the cam riding surfaces rotatably engaged with the cam lever axel, wherein the arm is configured to ambulate the install surface of the camming end across the cam shaft to produce a force tending to press together the lever unit and the cam base when the cam lever arm is rotated in one direction and to ambulate the remove surface across the cam shaft to produce a force tending to press apart the lever unit and the cam base when the cam lever arm is rotated in the other direction.

2. A system according to claim 1, wherein the cam shaft is generally cylindrical in shape.

3. A system according to claim 2, wherein the cylinder axis of the cam shaft is perpendicular to the lengthwise axis of at least one of the struts.

4. A system according to claim 1, wherein the guide pin comprises a guide pin stem connected to the cam base and a guide pin cap connected to the guide pin stem at the end opposite from the cam base.

5. A system according to claim 1, wherein the install surface is configured to contact the side of the cam shaft proximal to the cam base.

6. A system according to claim 1, wherein the remove surface is configured to contact the side of the cam shaft distal to the cam base.

7. A system according to claim 1, wherein the lever base defines a horizontal plane.

8. A system according to claim 7, wherein the plane of guide receptacle is parallel to the horizontal plane of the lever base.

9. An information handling system comprising:

(a) a processor;

(b) a memory communicatively coupled to the processor;

(c) a local storage resource communicatively coupled to the processor;

(d) a connector pair comprising a first connector piece and a second connector piece configured to communicatively couple and releasably engage the first connector piece;

(e) a cam platform fixed to the first connector piece, the cam platform comprising (i) a cam base, (ii) a cam arm extending vertically from the cam base and comprising a cam shaft and a pair of struts, each strut fixed to the cam shaft at one end and the cam base at the other end, (iii) a guide pin extending vertically from the cam base and parallel to the cam arm; and (f) a lever unit fixed to the second connector piece and separable from the cam platform, the lever unit comprising (i) a cam lever comprising a cam lever arm, a camming end comprising an install surface configured to contact at least a portion of the cam shaft, a remove surface configured to contact at least a portion of the cam shaft, and an axel operably linked to the arm and the camming end, and (ii) a lever platform comprising a lever base defining a guide receptacle configured to releasably receive the guide pin, a pedestal connected at one end to the lever base, a first and second plate, both connected to the end of the pedestal opposite from the lever base, each parallel to the other and parallel to the lengthwise axis of the pedestal, and each defining a cam ridding surface positioned to face the opposing cam riding surface, the cam riding surfaces rotatably engaged with the cam lever axel, wherein the cam lever arm is configured to ambulate the install surface of the camming end across the cam shaft to produce a force tending to press the cam base and the first connector piece together with the lever unit and the second connector piece when the cam lever arm is rotated in one direction and to ambulate the remove surface across the cam shaft to produce a force tending to press the cam base and the first connector piece apart from the lever unit and the second connector piece when the cam lever arm is rotated in the other direction.

10. An information handling system according to claim 9, wherein the first connector piece comprises an array of connector pins and the second connector piece comprises a corresponding array of holes configured to receive the connector pins.

11. An information handling system according to claim 9, wherein the second connector piece comprises an array of connector pins and the first connector piece comprises a corresponding array of holes configured to receive the connector pins.

12. An information handling system according to claim 9, wherein the cam platform is indirectly fixed to the first connector piece through a main board.

13. An information handling system according to claim 9, wherein the cam platform is indirectly fixed to the first connector piece through a card.

14. An information handling system according to claim 9, wherein the lever unit is indirectly fixed to the first connector piece through a main board.

15. An information handling system according to claim 9, wherein the lever unit is indirectly fixed to the first connector piece through a card.

16. An information handling system according to claim 9 further comprising:

(e) a second cam platform fixed to the first connector piece, the second cam platform comprising (i) a second cam base, (ii) a second cam arm extending vertically from the second cam base and comprising a second cam shaft and a second pair of struts, each second strut fixed to the second cam shaft at one end and the second cam base at the other end, (iii) a second guide pin extending vertically from the second cam base and parallel to the second cam arm; and (f) a second lever unit fixed to the second connector piece and separable from the cam platform comprising (i) a second cam lever comprising a second cam lever arm, a second camming end comprising a second install surface configured to contact at least a portion of the second cam shaft, a second remove surface configured to contact at least a portion of the second cam shaft, and a second axel operably linked to the second cam lever arm and the second camming end, and (ii) a second lever platform comprising a second lever base defining a second guide receptacle configured to releasably receive the second guide pin, a second pedestal connected at one end to the second lever base, a third and fourth plate, both connected to the end of the second pedestal opposite from the second lever base, each parallel to the other and parallel to the lengthwise axis of the second pedestal, and each defining a cam ridding surface positioned to face the opposing cam riding surface, the cam riding surfaces rotatably engaged with the second cam lever axel, wherein the second cam lever arm is configured to ambulate the second install surface of the second camming end across the second cam shaft to produce a force tending to press the second cam base and the first connector piece together with the second lever unit and the second connector piece when the second cam lever arm is rotated in one direction and to ambulate the second remove surface across the second cam shaft to produce a force tending to press the second cam base and the first connector piece apart from the second lever unit and the second connector piece when the second cam lever arm is rotated in the other direction.

17. An information handling system according to claim 16, wherein the cam platform is adjacent to one end of the first connector piece and the second cam platform is adjacent to an opposite end of the first connector piece.

18. An information handling system according to claim 16, wherein the lever unit is positioned adjacent to one end of the second connector piece and the second lever unit is positioned adjacent to an opposite end of the second connector piece.

19. A method of connecting a first and second mateable connector to each other, the method comprising:

(a) grossly aligning a first connector piece and a lever unit fixed to a first information handling system component with a second connector piece and a cam platform, respectively, fixed to a second information handling system component, wherein the cam platform comprises (i) a cam base, (ii) a cam arm extending vertically from the cam base and comprising a cam shaft and a pair of struts, each strut fixed to the cam shaft at one end and the cam base at the other end, (iii) a guide pin extending vertically from the cam base and parallel to the cam arm, and the lever unit comprises (i) a cam lever comprising a cam lever arm, a camming end comprising an install surface configured to contact at least a portion of the cam shaft, a remove surface configured to contact at least a portion of the cam shaft, and an axel operably linked to the arm and the camming end, and (ii) a lever platform comprising a lever base defining a guide receptacle configured to releasably receive the guide pin, a pedestal connected at one end to the lever base, a first and second plate, both connected to the end of the pedestal opposite from the lever base, each parallel to the other and parallel to the lengthwise axis of the pedestal, and each defining a cam ridding surface positioned to face the opposing cam riding surface, the cam riding surfaces rotatably engaged with the cam lever axel, wherein the cam lever arm is configured to ambulate the install surface of the camming end across the cam shaft to produce a force tending to press the cam base and the first connector piece together with the lever unit and the second connector piece when the cam lever arm is rotated in one direction;

(b) inserting at least a portion of the guide pin into the guide receptacle;

(c) moving at least a portion of a camming end of a cam lever across a camming surface of a cam shaft; and (d) translating the lateral movement across the camming surface into vertical movement to press together the first and second connector pieces.

20. A method according to claim 19, wherein the first information handling system component is a main board and the second information handling system component is a card.

* * * * *